United States Patent [19]

Demuth et al.

[11] 4,353,149

[45] Oct. 12, 1982

[54] FLAT CLEANING SYSTEM FOR A CARD

[75] Inventors: Robert Demuth, Wallisellen; Anton Wüest, Winterthur, both of Switzerland

[73] Assignee: Rieter Machine Works Ltd., Winterthur, Switzerland

[21] Appl. No.: 205,963

[22] PCT Filed: Oct. 22, 1979

[86] PCT No.: PCT/EP79/00081

§ 371 Date: Jul. 7, 1980

§ 102(e) Date: Jun. 20, 1980

[87] PCT Pub. No.: WO80/00980

PCT Pub. Date: May 15, 1980

[30] Foreign Application Priority Data

Nov. 7, 1978 [CH] Switzerland ..... 11429/78

[51] Int. Cl.[3] ..... D01G 15/82

[52] U.S. Cl. ..... 19/107; 19/108; 19/110

[58] Field of Search ..... 19/98, 107, 108, 109, 19/110, 111; 15/301

[56] References Cited

U.S. PATENT DOCUMENTS

| | | | |
|---|---|---|---|
| 2,327,349 | 8/1943 | Goldsmith | 19/109 |
| 4,075,732 | 2/1978 | Araki et al. | 19/107 X |
| 4,196,497 | 4/1980 | Beneke et al. | 19/107 |
| 4,227,285 | 10/1980 | Hamrick | 19/107 |

FOREIGN PATENT DOCUMENTS

| | | | |
|---|---|---|---|
| 1118662 | 11/1961 | Fed. Rep. of Germany . | |
| 1292551 | 4/1969 | Fed. Rep. of Germany . | |
| 1510314 | 11/1969 | Fed. Rep. of Germany | 19/107 |
| 2403402 | 4/1979 | France . | |
| 1038426 | 8/1966 | United Kingdom . | |
| 2003202 | 3/1979 | United Kingdom . | |

*Primary Examiner*—Louis Rimrodt

*Attorney, Agent, or Firm*—Werner W. Kleeman

[57] ABSTRACT

Flat cleaning system for a card equipped with a set of revolving flats, in which the flats (12) consist of a T-shaped profile, and in which, by temporary sealing, of the room between the webs 18, 18*a* of two neighboring flats (12,12*a*) using a sealing element 30, a longitudinal duct is formed, in which duct an air stream is generated. By this air stream, any fly waste accumulated on the back side of, and between the flats 12, 12*a* is eliminated. The air stream in the duct, generated by lateral suction, cleans any fly waste and dust particles accumulated in the duct out of the duct, only low energy suction being required.

11 Claims, 6 Drawing Figures

FLAT CLEANING SYSTEM FOR A CARD

The present invention concerns a flat cleaning system for a card equipped with a set of revolving flats, the individual flats of which are not in mutual contact, each flat consisting of a T-shaped profile. The legs of the flat are arranged on both sides and support a point clothing on their working surface. The web of the point clothing extends towards the inside of the flat room formed by the set of flats, and in this sytem the part of the revolving flat set located at the main drum is guided along the surface of the main drum.

On the cards equipped with the above mentioned set of flats the problem arises, that fine and finest fibre and dirt particles penetrate via the gaps between neighbouring flats. This occurs mainly in the part of the set of revolving flats located at the main drum into the inside room formed by the set of flats, where they can accumulate and form undesirable and dangerous fibre and waste accumulations. At the deflection points of the set of flats this accumulation can particularly take the form of fibre rolls.

According to a prior art solution to this problem (German DE-AS 11 18 662), penetration of fly waste and of dirt particles via the gaps between two stationary flats is prevented by providing seals which seal these gaps air-tight. A solution of this type, however, involves considerable disadvantages in practical use, because it is difficult to manufacture, as well as maintain, long, straight seals.

In another known flat cleaning system, German DE-PS12 92 551 an air stream is blown into the flat-inside room from one side and is sucked off on the opposite side via suction openings together with the fly waste and the dirt particles taken up by the air stream. However, this sytem has substantial disadvantages. Initially, it involves a high energy consumption since the effectiveness of the blown air stream is insured only if it extends over the full width of the flat-room which acts as an open room. Furthermore, such strong blown air streams generate an above atmospheric pressure, which, even if slight, is noticeable, in the flat-room. This is undesirable because air charged with fly waste and dirt particles is blown out of the flat room which, for design reasons, canot be hermetically sealed against the surrounding room. The air contamination caused by this air escape cannot comply with the dust content standards presently required in carding rooms. Furthermore, such strong concentrated air streams generate local air vortex formations and dead zones, in which fly waste and contaminations still can accumulate.

SUMMARY AND OBJECTS OF THE INVENTION

It is an object of the flat cleaning system according to the present invention to eliminate the above-mentioned disadvantages of the known devices of this type and to create a flat cleaning system, which effectively cleans the flat-room with low energy consumption, and avoids any air vortex formation and dead zones.

It is another object of the present invention to maintain in the flat-room a slight vacuum at all times and thus excludes any escape of fly waste and dust particles to the surrounding room.

These objects and others are achieved by a flat cleaning system of the type mentioned initially, in which the space between the webs of two neighbouring flats is temporarily sealed substantially air tight. The sealing element extends over the full length of the flats, forming a duct as the flats revolve. Also means for generating an air stream are coordinated to the duct.

By temporarily forming a duct enclosed by the legs and webs of two neighbouring flats and by the sealing element, optimum conditions for eliminating fly waste and dirt particles present in the duct room are established. Insofar as generation of the air stream is limited to the duct room and the duct dimensions are small in comparison to the whole flat-room, a relatively low energy consumption can be insured. As the duct formed is sealed substantially air tight against the flat room, the air stream acting in the duct does not influence the air present in the rest of the flat-room, and, in particular, does not create a pressure above atmospheric pressure in the flat room. Thus, a slight vacuum can also be established in the flat-room using conventional means, and the desired environmental requirements can be achieved.

Furthermore, the sealing element can extend, according to an alternative embodiment of the present invention over a plurality of neighbouring flats. According to a particularly favourable embodiment the sealing element extends substantially over all flats located at the main drum.

The sealing element can consist of a fixed, substantialy rigid plate which hugs the curvature of the flat path in the direction of the flat movement. The free end of the flat web moves along this plate forming a sealing point, or can consist, according to a further embodiment of a fixedly arranged, flexible apron supported on the upper part of the webs of the flats.

The means for generating an air stream in the duct comprise, according to an embodiment of the present invention, a suction duct merging into the duct at the face side.

With these and other objects, advantages and features of the invention that may become hereinafter apparent, the nature of the invention may be more clearly understood by reference to the following detailed description of the invention, the appended claims and to the several drawings attached herein.

Figure 1:
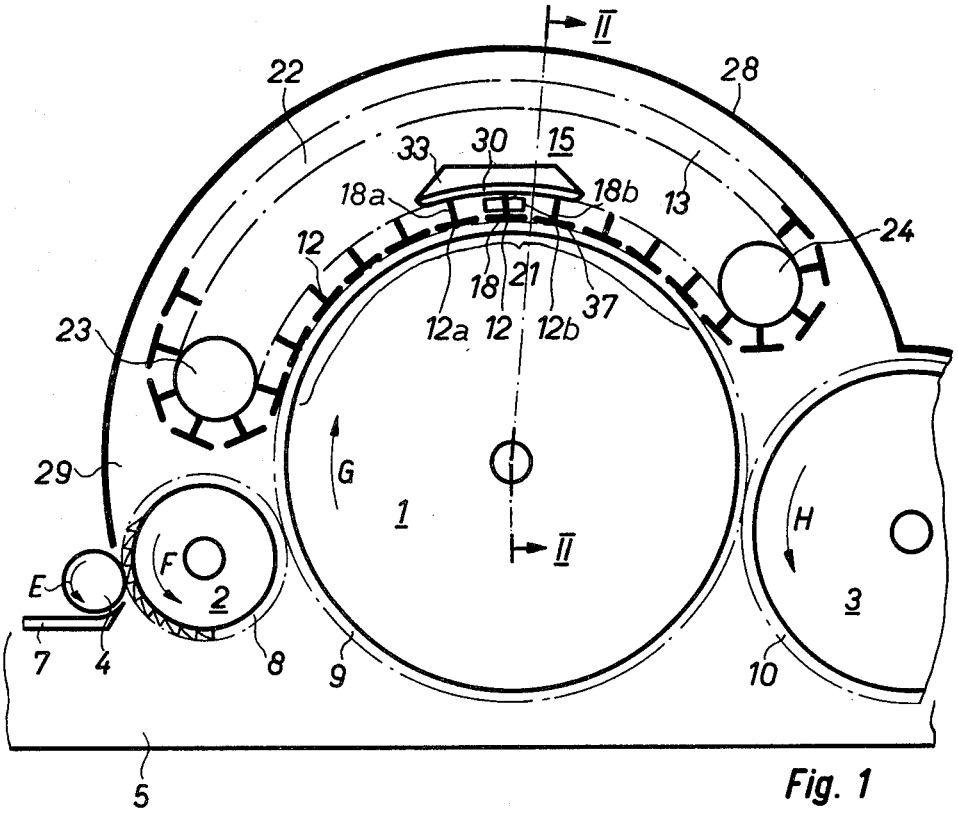
FIG. 1 is a schematic cross-section of the main working elements of a card, with a flat cleaning system according to the present invention.
Figure 4:
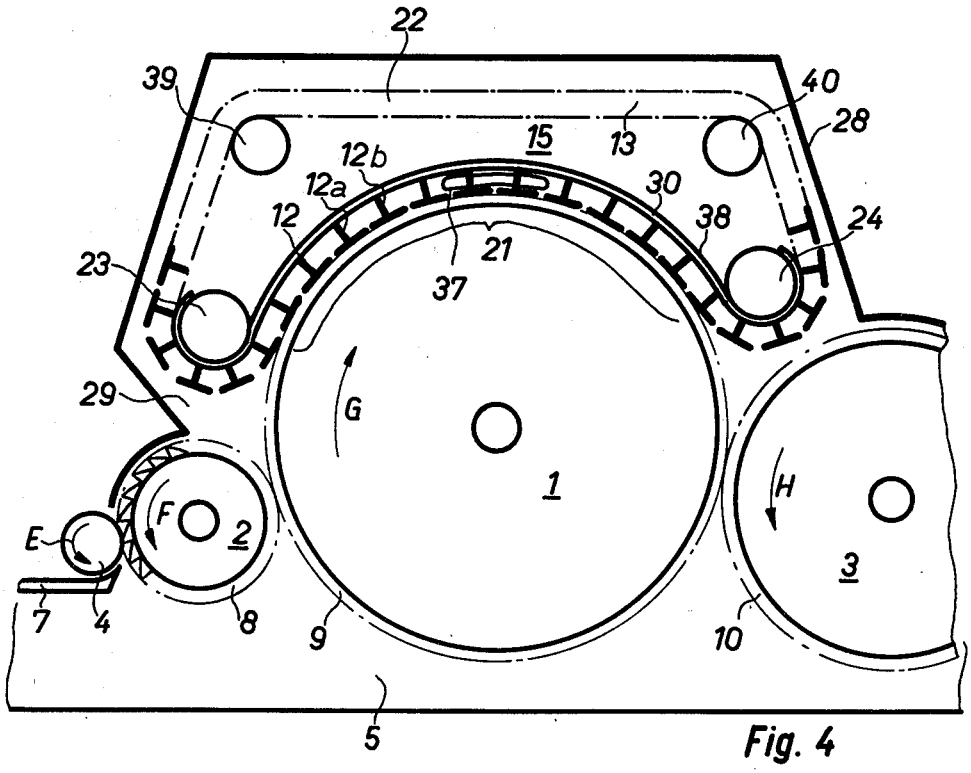
Figure 5:
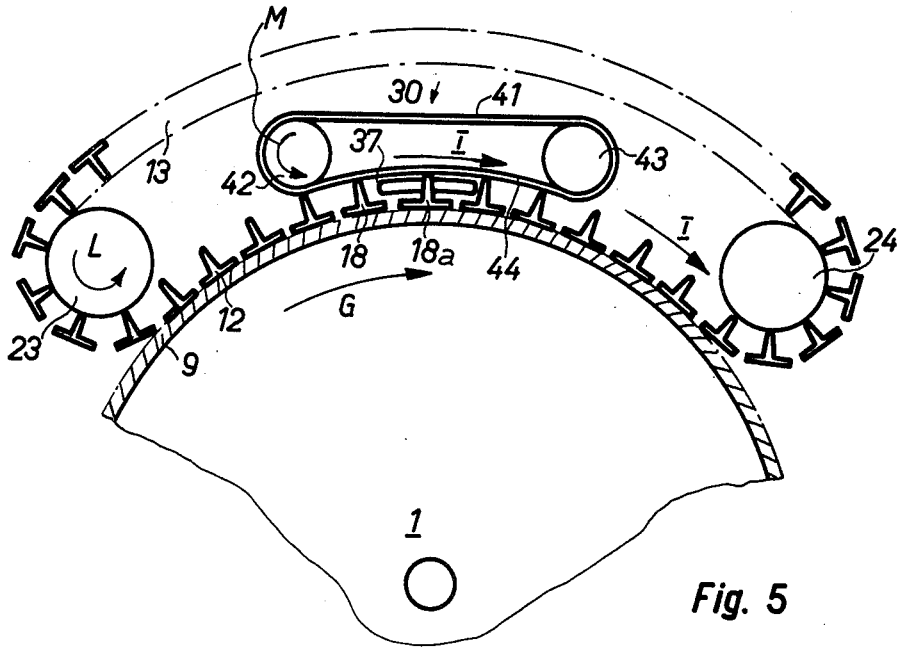
Figure 6:
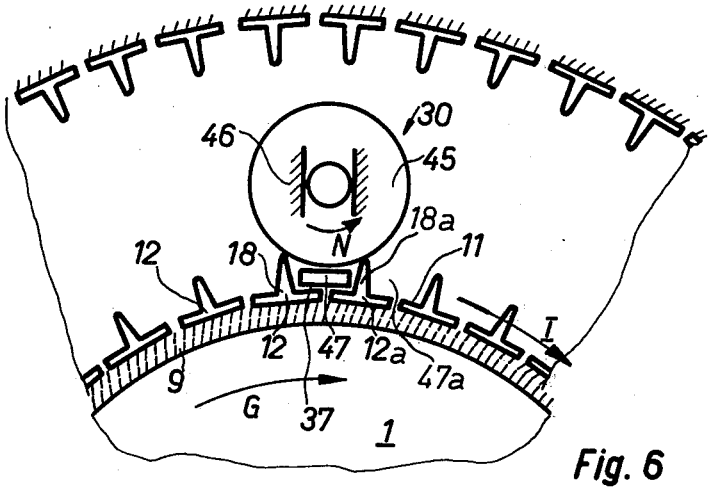

FIG. 4 is an alternative embodiment of the inventive flat cleaning system in a view corresponding to the one shown in FIG. 1; FIG. 5 is another embodiment of the inventive system, in which only the set of flats and a part of the main drum of the card are shown in a schematic view; and FIG. 6 is a further alternative embodiment of the present invention shown in a schematic view, only a part of the set of flats being shown.

DETAILED DESCRIPTION OF THE PREFERRED EMBODIMENT

Figure 2:
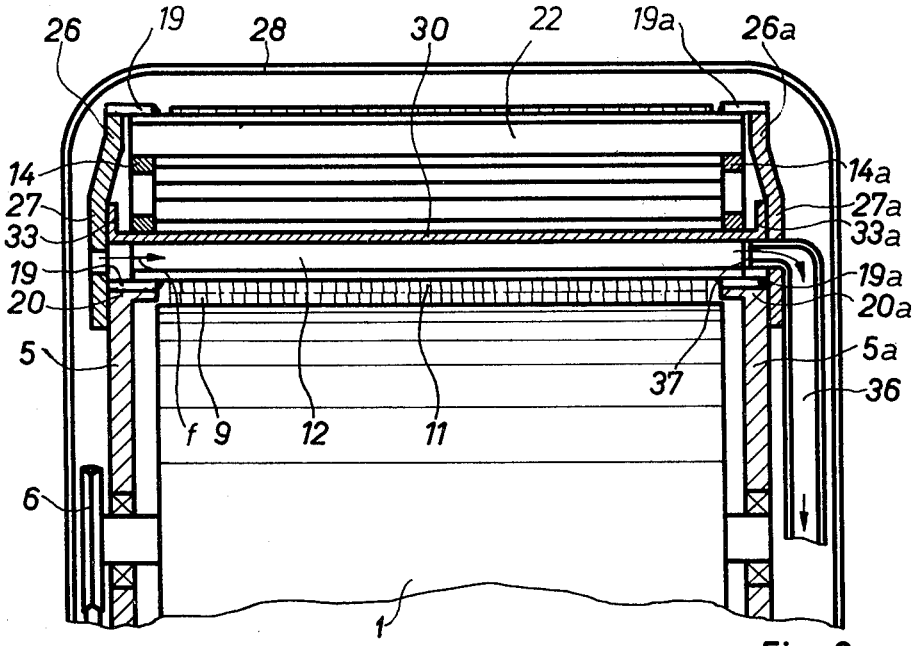
FIG. 2 is a section of the card according to FIG. 1, along the line II—II of FIG. 1.

In FIG. 1, in a so-called revolving flat card, the main drum is designated 1, the taker-in or licker-in 2, the doffer cylinder 3, and the feed roll 4. These four rolls or cylinders are rotatably supported at both sides in bearings (not shown) fixedly arranged with respect to the room in a frame (merely indicated) 5, or 5*a* respectively, of the card. The rolls are driven at predetermined mutual rotational speed ratios and directions of rotation by known means, of which only the drive belt pulley 6 of the main drum 1 is shown in FIG. 2. The fibre material in the form of a layer of flocks is supplied to the feed roll 4, which rotates in the direction of the arrow E, on a trough-shaped feeder plate 7, is caught by the teeth of the point clothing 8 of the licker-in or taker-in 2 and is carried on in the direction of the arrow F. The main drum 1 is also provided with a point clothing 9, which is particularly shown in FIG. 3 which shows an enlarged detail of the main drum periphery, among other items. The points of the point clothing 9 of the main drum 1 take over the fibres, or the fibre flocks respectively, from the clothing 8 of the licker-in 2 and bring them, according to the rotation of the main drum 1 in the direction of the arrow G, to the fibre transfer point, i.e. to the point of contact between the clothing 9 of the main drum 1 and the point clothing 10 of the doffer cylinder 3, which rotates in the direction of the arrow H. At this point, the fibres or the fibre flocks, respectively, are transferred to the doffer cylinder and to the take-off device (not shown) of the card. Within the zone of the main drum 1, between the transfer points from the licker-in 2 to the main drum 1 and from the main drum 1 to the doffer cylinder 3 the actual carding of the fibre material is effected. In this process, the fibres placed on the surface of the main drum clothing 9 (FIG. 3) are pulled through between the main drum clothing 9 and the point clothing 11 (FIGS. 2 and 3) of the slowly revolving card flats 12 (and **12*a*, 12*b*, etc., respectively). The card flats 12, 12*a*, etc. are interconnected by chains or connecting elements 14, and 14*a* (FIG. 2) into a slowly revolving set of flats, in such a manner that they form a closed arrangement. The inside room of this arrangement is designated in this context as a flat room 15 formed by the set of flats 13**.

The flats **12, 12*a*, 12*b*, etc. each consist of a T-shaped profile, the legs 16 and 16*a* (FIG. 3) of which, arranged on both sides, are provided with the point clothing 11 on their working surface 17. The web 18 of the flats 12, 12*a*, 12*b*, etc. extends towards the inside of the flat room 15. The T-shaped flat profiles extend, as shown in FIG. 2, over the full width of the main drum 1 and are guided on both sides using gliding shoes 19, 19*a* on arched guide rails 20, 20*a* formed by the side walls of the card frame 5 substantially parallel to the main drum. That is, the flat profiles are guided along the surface of the main drum 1**.

Figure 3:
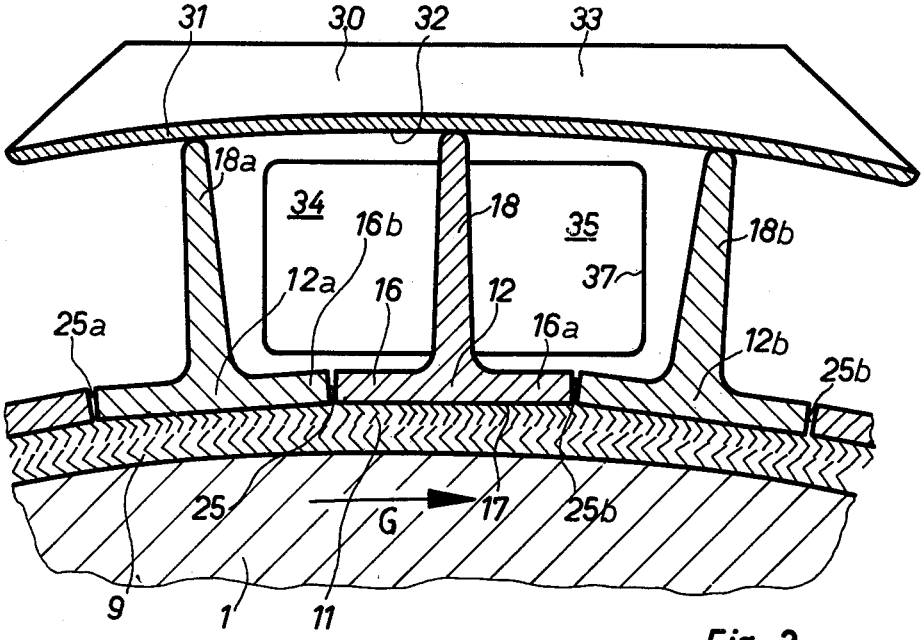
FIG. 3 is an enlarged detail of FIG. 1.

The flat set 13 consists substantially of two groups, namely the group of the flats 21 along the main drum 1, and the group of the flats 22 returning, and of two flat turning points 23 and 24. The structure of the two turning points is known in the art and a further description is thus not included herein. Along the run 21 of the flats in the working position, the flats **12, 12*a*, etc., as shown in FIG. 3, are lined up adjacent in a row. The legs 16, 16*a* of neighbouring flats 12, 12*a* are arranged in close vicinity, but no mutual, air-tight seal is provided between them, i.e. the flats 12, 12*a* are not in mutual contact. Between the flats thus a long, narrow gap 25 is formed, via which individual fibres or small fibre aggregates from the main drum surface can penetrate into the flat room 15, where they are deposited mainly in the room formed between two neighbouring flat webs 18 and 18*a*** on the inner side of the flats.

FIG. 2 shows the manner in which the flats **12, 12*a*, 12*b*, etc. are guided along the path of the return run 22 of the flats by arched guide members 26, 26*a*. Almost concentrically with respect to the main drum 1, the gliding shoes 19 and 19*a* are used in this embodiment. The guide members 26, and 26*a* respectively, are formed by two support members 27, and 27*a* respectively, and are mounted onto the card frame 5, and 5*a*** respectively.

All of the room of the flat set 13 is separated also from the surrounding room by a hood 28, which is provided with seals (not shown) in such manner that a vacuum can be maintained in its inside room 29. This is accomplished by connecting it to an external vacuum source, the vacuum required being of the order of a few mm water column. A vacuum of this type is sufficient to prevent fibres from escaping from the hood 28 to the surrounding room, but is, however, not sufficient to effectively preclude the deposition of fibres and fibre aggregates, which penetrates via the gap **25, 25*a*, etc. (FIG. 3), into the flat room 15, onto the flats 12, 12*a*, 12*b*, etc. For this purpose the inventive flat cleaning system is applied, in which in the embodiment according to FIGS. 1 through 3 a fixed sealing element 30 is provided over the flat webs 18, 18*a*, 18*b*, etc. along which the free end of the web 18, 18*a*, 18*b*, etc., moves (see FIG. 3) forming a sealing point. The sealing element 30 (FIG. 3) in this arrangement is formed by a plate 31 hugging the curved path of the flats, the stiffness of which plate 31 is increased, if required, by ribs not shown, in such manner that its surface 32 facing the webs 18, 18*a*, 18*b*, etc. is held in place practically contact-free and substantially air-tight over the whole width of the flats 12 opposite the webs 18, 18*a*, etc. The plate 31 is provided with ear-type extensions 33, 33*a* which are laterally mounted on the support members 27, 27*a*** by means not shown in detail.

Since the sealing element 30 extends, as shown in FIG. 3, over three neighbouring flats **12, 12*a* and 12*b*, two longitudinal ducts 34 and 35 are formed between the webs 18*a* and 18, and 18 and 18*b* respectively, of two neighbouring flats 12*a* and 12 and 12*b*** respectively, through which an air stream flows.

This air stream is generated e.g. by providing a suction duct 36 (FIG. 2.) merging at the face side of the duct 34, and 35 respectively, i.e. at the face side of the flats **12, 12*a*, 12*b*, etc. in the zone of the sealing element 30. In FIGS. 1 through 3 the orifice of the suction duct 36 merging at the face side is designated 37. The suction duct 36 is connected to suction means not shown, in such manner that a suction air stream in the ducts 34 and 35 (FIG. 3) according to arrow f (FIG. 2) is generated. This eliminates fibres, fibre aggregates and contaminations accumulated in the ducts 34 and 35 respectively. As shown in FIG. 3, the width of the orifice 37 of the suction duct 36 is chosen large enough so that it extends over two adjacent ducts 34 and 35 and thus generates an air stream simultaneously in both ducts 34 and 35. The width of the orifice 37 can also be smaller, so that an air stream is generated in only one duct between two flat webs. As the set of flats revolves slowly, as mentioned before, the direction of the revolving movement in this arrangement being of no importance, each flat 12, 12*a*, 12*b*, etc. from time to time is placed below the sealing element 30 in such manner that each flat, together with its neighbouring flat, temporarily forms a duct in which the cleaning air stream becomes effective. The cleaning element 30 does not necessarily extend, as shown in FIGS. 1 and 3, over a plurality of flats 12 and 12*a*, 12*b*. It is sufficient if it extends over e.g. the two webs 18, 18*a* of two neighbouring flats 18, 18*a*, in such manner that the air tight duct 34 is temporarily formed. For design stability reasons, however, use of a sealing element 30** extending over a plurality of flats is recommended.

As each flat revolves, is placed under the sealing element 30, or the plate 31 respectively, and the suction air stream effects an air flow through the duct and produces the desired cleaning effect. It should also be mentioned that, owing to the total cleaning air stream, it is possible to also subject the whole inside room 29 under the hood 28 to slight vacuum in such an advantageous manner that the above mentioned conditions for the air in the surrounding room are achieved. The hood 28 can also be connected to a separate suction duct (not shown). What is important, however, is the fact that due to the formation of tightly enclosed ducts 34, 35 between the flat webs 18, 18*a*, 18*b*, etc., the action of a relatively feeble suction air stream is entirely sufficient for insuring cleaning of the whole flat-room 15, without requiring application (as in the known cleaning systems according to the state of the art) of a blow air stream (causing above atmospheric pressure and vortex formation in the flat-room 15).

In FIG. 4, in which elements identical to those shown in FIGS. 1 through 3 are designated with the same reference numbers, the sealing element 30 extends substantially over all flats 12, 12*a*, etc., of the run of the flat set 21 located at the main drum 1. It consists of a fixed, flexible apron 38, which is supported on the webs 18, 18*a*, etc. of the flats 12, 12*a*, etc., and which is anchored at the flat turning points 23, 24 by means not shown. Even if the flexible apron 38 which is preferably made from synthetic plastic material, converts all spaces between the webs of the flats 12, 12*a*, etc. of the run 21 of the set of flats into closed ducts, the inventive air stream can become effective in the one, or several ducts located in the zone of the orifice 37 of the suction duct (not shown) merging at the face side. This occurs in such a manner that the efficiency of the suction is insured notwithstanding the small suction air quantities utilized (and thus the small energy consumption). The arrangement shown here is an advantage over the solution shown in FIGS. 1 through 3. It permits separation of the flat room 15 into two separated spaces, namely the space above and below the apron 38, in such a manner that any effect from the gaps 25, 25*a*, etc. between the flats 12, 12*a*, etc., which in the solution according to FIG. 1 through 3 can eventually still cause small, detrimental air currents, is entirely avoided. Furthermore, the solution according to FIG. 4 yields sealing action advantages, as the sealing on the webs 18, 18*a*, etc., by the flexible apron 38 is self-regulating so to speak, under the influence of the action of the vacuum in the ducts between the flats 12, 12*a*, etc., in such manner that expensive machining operations on the webs 18, 18*a*, etc., and/or on the sealing element 30 is not necessary. Furthermore, application of two support rolls 39 and 40 for the return run 22 of the set of flats 13 are shown in FIG. 4, instead of the guide elements 26 and 26*a* shown in FIGS. 1 through 3, which can result in possible reduced manufacturing costs for this design.

The flexible apron 38 of preferentially synthetic plastic material is chosen as a thin apron, the surface of which facing the free end of the flat webs 18, 18*a*, etc. (see FIG. 3) is a low friction surface with low electrostatic chargeability. Thus, the sliding friction of the drive of the flat set 13 can be reduced. Also, electrostatically caused clinging of fibres on the sliding surface of the apron 38 can be precluded. As an apron 38, e.g. a polyester apron of the type Transilon E2/2-U0/V2 with PVC coat, as manufactured by Siegling AG, P. Box 5346, D-3000 Hannover 1, can be used.

In FIG. 5 a further alternative embodiment of the present inventive flat cleaning system is shown, which differs from the embodiments according to FIGS. 1 through 4 described above, because the sealing element 30 in this arrangement is not stationary, but is a body rolling on the webs 18, 18*a*, etc. In FIG. 5, as a sealing element 30 e.g. a revolving apron 41 was applied, tensioned between two rotatably supported rolls 42 and 43, the lower run 44 of which is supported on the free ends of the webs 18, 18*a*, etc. of the flats 12, 12*a*, etc.

The apron 41 can thus follow the movement of the set of flats 13 e.g. in the direction of the arrows I (the roll of the turning point 23 in this case rotating counter clockwise, as indicated by the arrow L) preferably at the same speed, i.e. the apron revolves about the rolls 42 and 43 also counter clockwise (arrow M at the roll 42). In this arrangement, the apron 41 can be equipped with its own drive mechanism (not shown) or can be carried by friction on the webs 18, 18*a*, etc., of the flats 12, 12*a*, etc. The apron 41 of course extends over the full width of the flats 12, 12*a* and is guided and sealed laterally by means not shown.

Also in this embodiment a lateral suction opening 37 is provided, which, as described with reference to the above mentioned embodiments, is connected with a suction source (not shown) for generating a suction air stream in one or a plurality of ducts between the flats 12, 12*a*, etc. (in the embodiment shown the apron 41 forms four ducts).

The embodiment according to FIG. 5 shows the advantage that the air tight sealing of the room between the webs 18, 18*a* etc., of two neighbouring flats is effected without causing friction.

In FIG. 6 a further alternative embodiment of the present inventive flat cleaning system is shown, in which the sealing element 30, like the one according to the embodiment described with reference to FIG. 5 is designed as a body rolling on the webs 18, 18*a*, etc., thus yielding advantages similar to those mentioned above. The sealing element 30 shown in FIG. 6 is designed as a roll 46, which is movably radially guided with respect to the surface of the main drum 1 in two lateral bearings 46 (one only being shown), and which is temporarily supported on two webs 18, 18*a* of two neighbouring flats 12, 12*a* with its cylindrical surface. It thus seals the inventive longitudinal duct 47 between the webs 18, 18*a*.

The revolving movement of the flat set 13, e.g. in the direction of arrow I, causes the roll 45 to rotate counter clockwise (arrow N), the roll 45 in this arrangement also effecting a vertical movement and eventually being temporarily supported on a single web 18*a*. To obtain a prolonged sealing time of the duct 47, various means can be applied, if required, e.g. the roll 45 can be provided with a soft cover coat (not shown), or a certain movability in the direction of the movement of the flats, i.e. in the direction of arrow I, can be provided.

I claim:

1. A flat cleaning system for cards comprising a set of revolving flats, the individual flats not being in mutual contact, each flat having a T-shaped profile with legs on both sides of a web which extends towards the inside of the flat room formed by the set of flats, the legs supporting a point clothing on their working surface, and the group of flats located at the main drum being guided along the surface of the main drum;

a sealing element adapted to temporarily form an air tight seal between the room formed by the set of revolving flats and the particular neighboring flats the seal is temporarily disposed over;

said sealing element forming at least one duct between the neighboring flats as the set of flats revolve;

said sealing element including a fixed plate which hugs the curvature of the flat path in the direction of the flat movement and along which the free end of the web moves in order to form a sealing point; and air stream generating means, coordinated to said at least one duct, for cleaning said flats.

2. Flat cleaning system according to claim 1, wherein the sealing element extends over a plurality of neighbouring flats.

3. Flat cleaning system according to claim 1, wherein the sealing element extends substantially over all flats located at the main drum.

4. Flat cleaning system according to claim 1, wherein the sealing element consists of a fixed, flexible apron which is supported on the upper side of the webs.

5. Flat cleaning system according to claim 4, wherein the apron consits of synthetic plastic material.

6. Flat cleaning system according to claim 4, wherein the apron on the side facing the webs is provided with a low friction and low electrostatic chargeability surface.

7. Flat cleaning system according to claims 3 or 4, further including flat deflecting means around which the set of flats revolves to which the flexible apron is anchored.

8. Flat cleaning system according to claim 1, further including suction duct means leading to the means for generating an air stream which air stream generating means merges into the duct at its face side.

9. Flat cleaning system according to claim 1, wherein the sealing element is formed by a body which rolls on the webs of the flats.

10. Flat cleaning system according to claim 1, wherein sealing action occurs between webs of the neighboring flats directly at the webs themselves whereby the use of elastic sealing bodies is rendered unnecessary.

11. Flat cleaning system according to claim 1, wherein suction action occurs in the lengthwise direction of the individual flats.

* * * * *